US006599111B2

(12) United States Patent
Ohtaki et al.

(10) Patent No.: US 6,599,111 B2
(45) Date of Patent: Jul. 29, 2003

(54) VANE PUMP HAVING AN INTAKE GROOVE THROUGH A SIDE WALL MEMBER

(75) Inventors: Mizuo Ohtaki, Kanagawa (JP); Kazuyoshi Ishizaki, Kanagawa (JP); Yukio Uchida, Kanagawa (JP); Miyoko Hamao, Kanagawa (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 0 days.

(21) Appl. No.: 09/984,260

(22) Filed: Oct. 29, 2001

(65) Prior Publication Data

US 2002/0051721 A1 May 2, 2002

(30) Foreign Application Priority Data

Oct. 30, 2000 (JP) ..... 2000-330896

(51) Int. Cl.[7] ..... F04C 2/344
(52) U.S. Cl. ..... 418/132; 418/133; 418/135
(58) Field of Search ..... 418/132, 133, 418/135

(56) References Cited

U.S. PATENT DOCUMENTS

| | | | | | |
|---|---|---|---|---|---|
| 2,653,550 | A | * | 9/1953 | Gardiner et al. | 418/133 |
| 3,216,363 | A | * | 11/1965 | Snow et al. | 418/135 |
| 3,647,328 | A | * | 3/1972 | Fox | 418/136 |
| 4,072,450 | A | * | 2/1978 | Carlson | 418/133 |
| 4,080,124 | A | * | 3/1978 | Drutchas et al. | 418/267 |
| 4,199,304 | A | * | 4/1980 | Strikis et al. | 418/135 |
| 6,050,796 | A | | 4/2000 | Wong et al. | 418/132 |
| 6,082,983 | A | | 7/2000 | Hayashi et al. | 418/133 |

FOREIGN PATENT DOCUMENTS

| | | | | |
|---|---|---|---|---|
| JP | 57-390 | * | 1/1982 | 418/133 |
| JP | 59-113287 | * | 6/1984 | 418/133 |
| JP | 59-180088 | * | 10/1984 | 418/133 |
| JP | 4-76984 | | 7/1992 | |
| JP | 6-14481 | | 2/1994 | |
| JP | 10-184563 | | 7/1998 | |

* cited by examiner

*Primary Examiner*—John J. Vrablik
(74) *Attorney, Agent, or Firm*—Sughrue Mion, PLLC

(57) ABSTRACT

A vane pump comprising a pump housing, including an inlet, an outlet, and therein a hollow space, a cam ring received in the hollow space, a rotor placed in the cam ring and defining a rotation axis. The rotor comprises plural vanes arranged in corresponding slots formed in the rotor with a slidable contact in a radial direction of the rotor. A first wall member is received in the hollow space, one side of the first wall member faces one side of the cam ring, and the first wall member comprises an intake passage provided with a groove that is formed so that a partition wall portion is defined between the intake passage and an interface between the first wall member and the cam ring. A pair of intake ports are formed on the one side of the first wall member, each intake port is connected with the inlet by the intake passage, and a pair of outlet ports are formed on the one side of the first wall member.

27 Claims, 13 Drawing Sheets

VANE PUMP HAVING AN INTAKE GROOVE THROUGH A SIDE WALL MEMBER

BACKGROUND OF THE INVENTION

1. Field of the Invention

This invention relates to a vane pump, and in particular a vane pump that is suitable as an oil pressure source for a power steering device of an automotive vehicle.

2. Description of the Related Art

As is generally known, there have been proposed vane pumps for a power-steering system of an automotive vehicle. The vane pump typically includes a rotor placed in a cam ring that is received in a pump housing. Plural vanes are slidably provided in corresponding slots formed in the rotor, and a pair of wall members are provided to close both side surfaces of the cam ring. By this arrangement, a pump operation is performed with a rotation of the rotor as a top portion of each vane, and both side surfaces of each vane touch an inner surface of the cam ring, and surfaces of the wall members facing the vane, respectively. This type of apparatus is disclosed in, for example, Japan Utility Model Publication (koukai) No. 6-14481, and Japan Patent Publication (koukai) No. 10-184563.

As shown in FIG. 18 illustrating one conventional design, oil is supplied from an oil intake passage 101 to an intake port. An intake chamber 102 provided with a concave-shaped groove in its cross section is formed on a rear housing 104 that faces a cam ring 103 in an axial direction of the cam ring 103. The intake chamber 102 is arranged at an outer portion of the cam ring 103 in a radial direction of the cam ring 103 to avoid an interference with the cam ring 103. Thus, a size of the vane pump in the radial direction of the cam ring 103 is expanded, when the intake chamber 102 that has a large cross sectional area is formed for the purpose of increasing an induction efficiency. However, since it is undesirable that the size of the vane pump becomes large in view of downsizing, there is a difficulty in providing a compact vane pump that has an intake chamber 102 with a large cross section area. Therefore, it has been difficult to increase the induction efficiency. While the area of the intake chamber 102 can be enlarged by expanding the intake chamber 102 in the axial direction of the cam ring 103, since the intake chamber 102 is provided with a flat shape cross section, a strong flow resistance results that would cause a decrease of the induction efficiency.

As shown in FIG. 19 illustrating another conventional design, a fluid chamber 202 is formed inside of a housing member 201, and receives a pressure plate 203, a cam ring 204, and a thrust plate 205. The pressure plate 203 and the thrust plate 205 are arranged for closing both sides of the cam ring 204. The fluid chamber 202 is formed into a cylindrical shape. A low-pressure fluid passage 206, which constitutes an intake passage, is formed on an inner surface of the fluid chamber 202 that faces an outer surface of the cam ring 204. The low-pressure fluid passage 206 is provided with a concave-shaped groove in its cross section. However, since the low-pressure fluid passage 206 is located at an outside of the cam ring 204 with respect to a diameter of the cam ring 204, it is difficult to provide the low-pressure fluid passage 206 that has a large cross sectional area, keeping the compactness. Therefore, the area of the low-pressure fluid passage 206 cannot be enlarged enough.

SUMMARY OF THE INVENTION

Accordingly, in view of above-described problems encountered in the related art, a principal object of the present invention is to provide a vane pump that has an intake passage with a large cross sectional area.

Another object of the present invention is to provide a vane pump that is compact.

Still another object of the present invention is to provide a vane pump that is easy to assemble.

In order to achieve these and other objects, there is provided a vane pump that comprises a pump housing that includes an inlet, an outlet, and therein a hollow space, a cam ring received in the hollow space, and a rotor placed in the cam ring. The rotor defines a rotation axis and comprises plural vanes arranged in corresponding slots formed in the rotor with a slidable contact in a radial direction of the rotor. A first wall member is received in the hollow space, with one side of the first wall member facing one side of the cam ring, the first wall member comprising an intake passage provided with a groove that is formed so that a partition wall portion is defined between the intake passage and an interface between the first wall member and the cam ring. A pair of intake ports are formed on the one side of the wall member, and each intake port is connected with the inlet by the intake passage. A pair of outlet ports are formed on the one side of the first wall member.

Other aspects and advantages of the invention will become apparent from the following description, taken in conjunction with the accompanying drawings, illustrating by way of example the principles of the invention.

DETAILED DESCRIPTION OF THE PREFERRED EMBODIMENT

A vane pump according to preferred embodiments will now be described with a reference to the drawings. FIGS.

Figure 1:
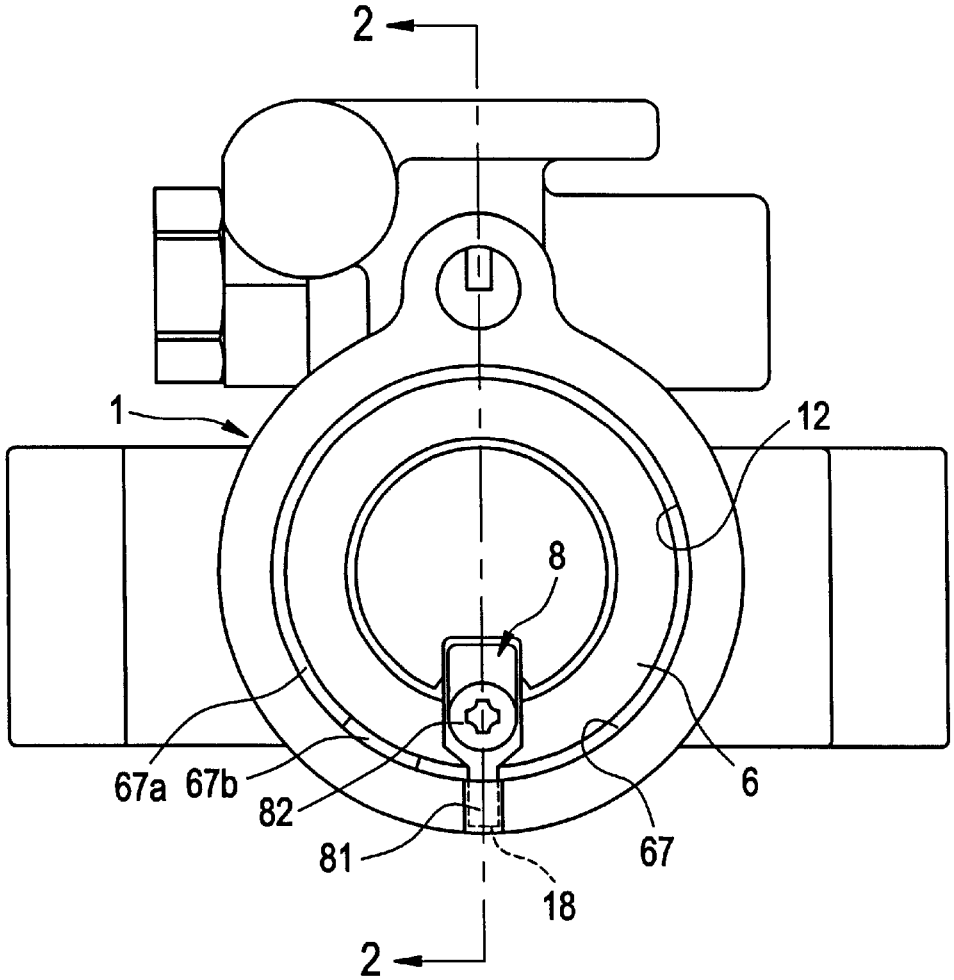
FIG. 1 is a front view of a vane pump according to a first embodiment of the present invention.
Figure 2:
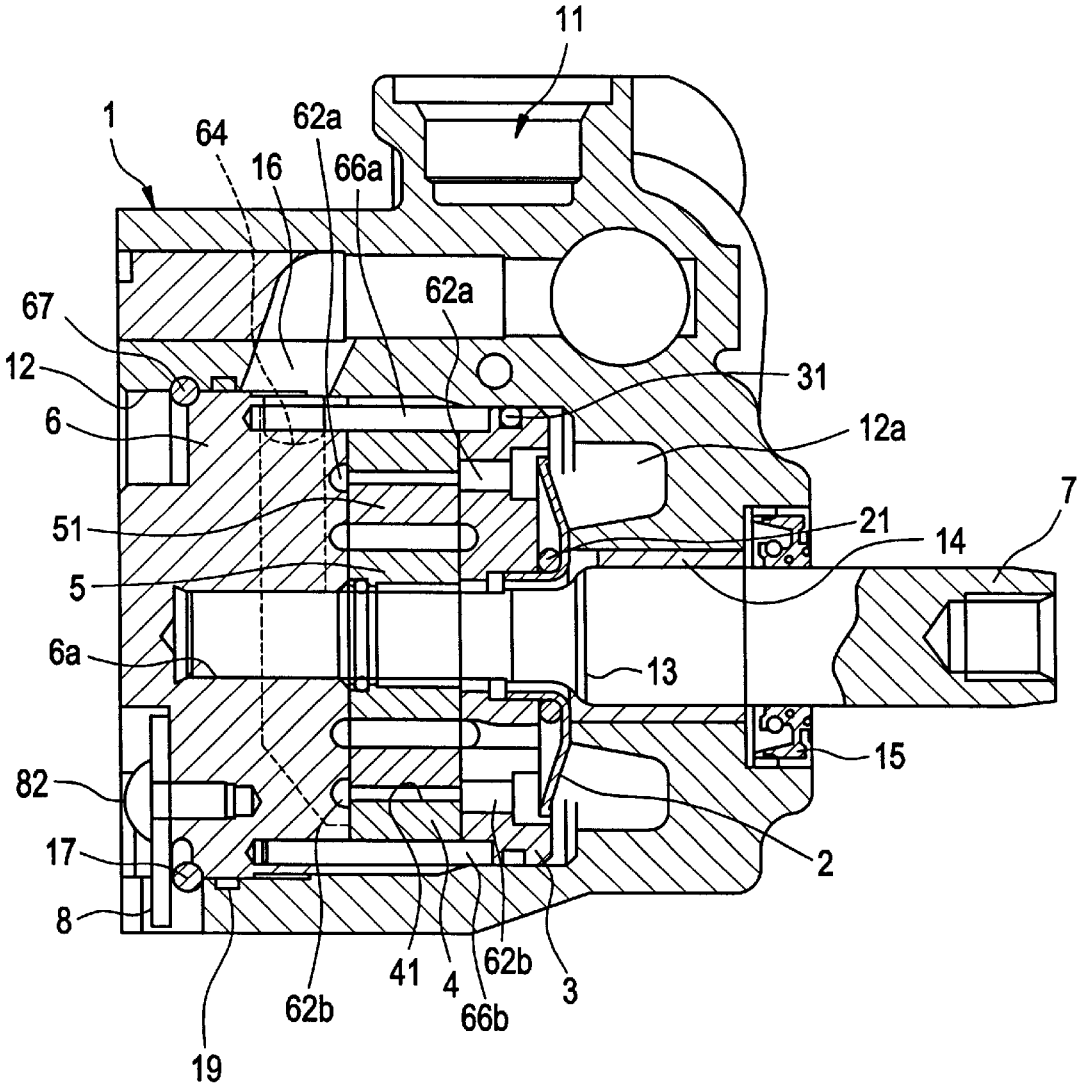
FIG. 2 is a sectional view taken on line 2—2 of FIG. 1.
Figure 3:
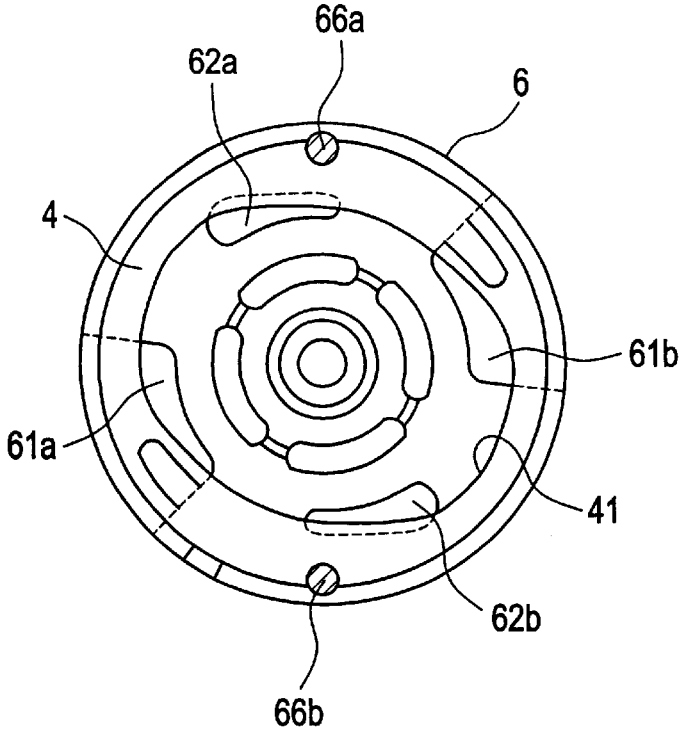
FIG. 3 is a cross sectional view of a cam ring.
Figure 4:
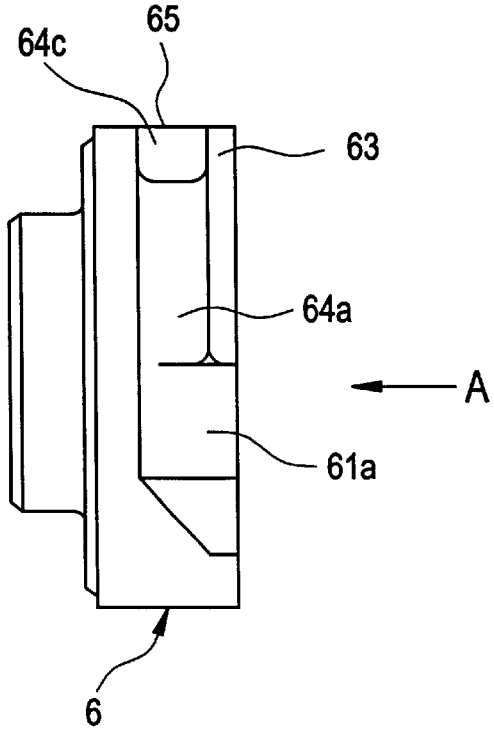
FIG. 4 is a side view of a first wall member of the first embodiment.
Figure 5:
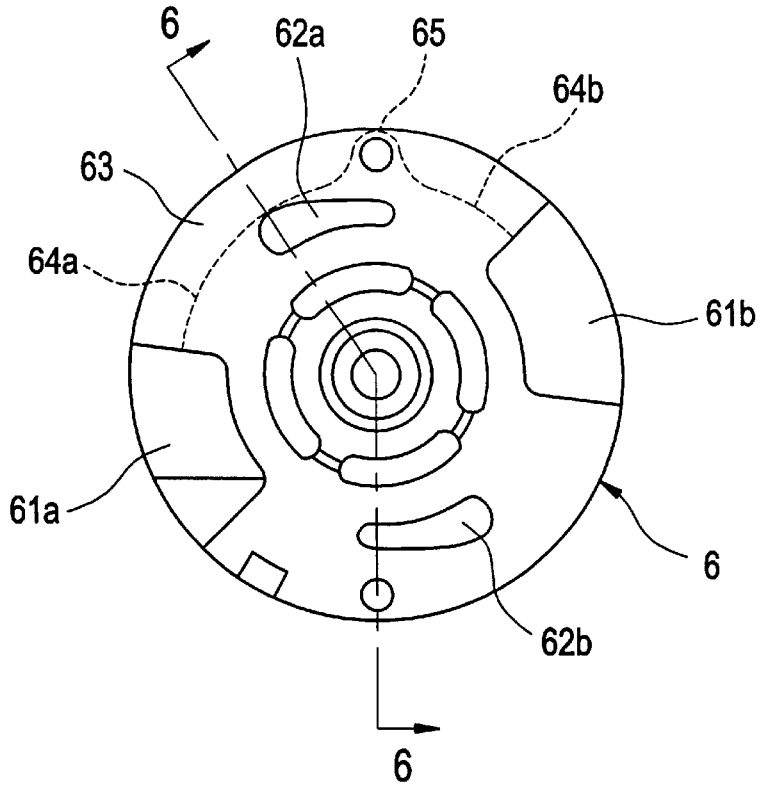
FIG. 5 is a side view taken from arrow A of FIG. 4.
Figure 6:
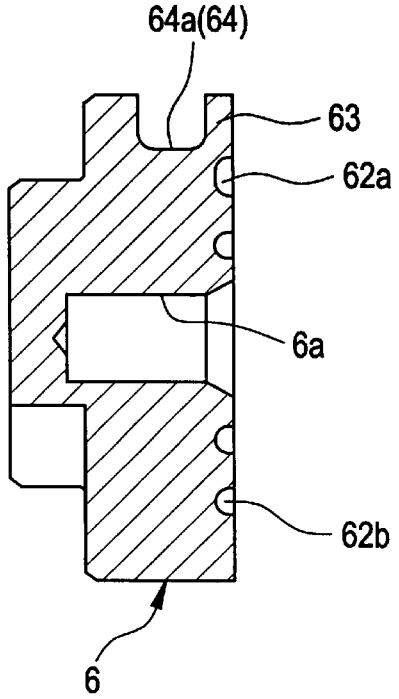
FIG. 6 is a cross sectional view of the first wall member taken on line 6—6 of FIG. 5.

1–7 show a first embodiment of the present invention. As shown in FIGS. 1–3, a vane pump comprises a pump housing 1, a pressure-spring 2, a first wall member 6, a second wall member 3, a cam ring 4, a rotor 5, and a drive shaft 7. The pump housing 1 has an inlet 11, an outlet (not shown), a hollow space 12, and a drive shaft bore 13. The hollow space 12, an opening of which is provided at one side of the pump housing 1, is formed in the pump housing 1. The drive shaft bore 13 is formed at the other side of the pump housing 1. The hollow space 12 and the drive shaft bore 13 have the same axis that defines a rotation axis of the rotor 5. The drive shaft bore 13 intersects a bottom surface of the hollow space 12 and opens through both sides of the pump housing 1. The hollow space 12 receives, according to a direction from the bottom face to the opening of the hollow space 12, the second wall member 3, the cam ring 4 in which the rotor 5 is received, and the first wall member 6. The second wall member 3 is placed in the hollow space with a movable contact with respect to the cam ring 4 in the rotation axis. The drive shaft 7 is supported by a bearing 14 that is provided in the drive shaft bore 13, and an end portion of the drive shaft 7 is supported by a hole 6*a* that is formed on one side of the first wall member 6. Thus, the drive shaft 7 is supported by the bearing 14 and the hole 6*a*. There is provided an oil seal 15 at the other side of the pump housing 1 that seals an interface between an outer surface of the drive shaft 7 and an inner surface of the drive shaft bore 13. The cam ring 4 has an oval bore 41, and defines a pump chamber in cooperation with the first wall member 6, the rotor 5 and the second wall member 3. Both sides of the cam ring 4 are closed by the first wall member 6 and the second wall member 3. The rotor 5 is placed in the oval bore 41 and is fixed to the drive shaft 7. Plural vanes 51 that divide the pump chamber into plural small chambers are placed in the rotor 5. Each vane 51 is arranged in corresponding slots formed in the rotor 5 with a slidable contact in a radial direction of the rotor 5. Thus, a volume of each small chamber changes with a rotation of the rotor 5. A pair of intake ports 61*a*, 61*b*, through which a fluid is directed to the pump chamber, are formed on the one side of the first wall member 6, and are arranged symmetrically with respect to a center of the first wall member 6. Similarly, a pair of outlet ports 62*a*, 62*b* are formed on the one side of the first wall member 6, and are arranged symmetrically with respect to a radial direction of the first wall member 6. The outlet ports 62*a*, 62*b* are also formed on one side of the second wall member 3, and are symmetrically arranged with respect to each other. Thus, the outlet ports 62*a*, 62*b* are provided on both the first wall member 6 and the second wall member 3. Thereby, both sides of the rotor 5 receive a pressurized fluid. The pressurized fluid is directed to the outlet through the outlet ports 62*a*, 62*b* that are provided on the second wall member 3.

Figure 7:
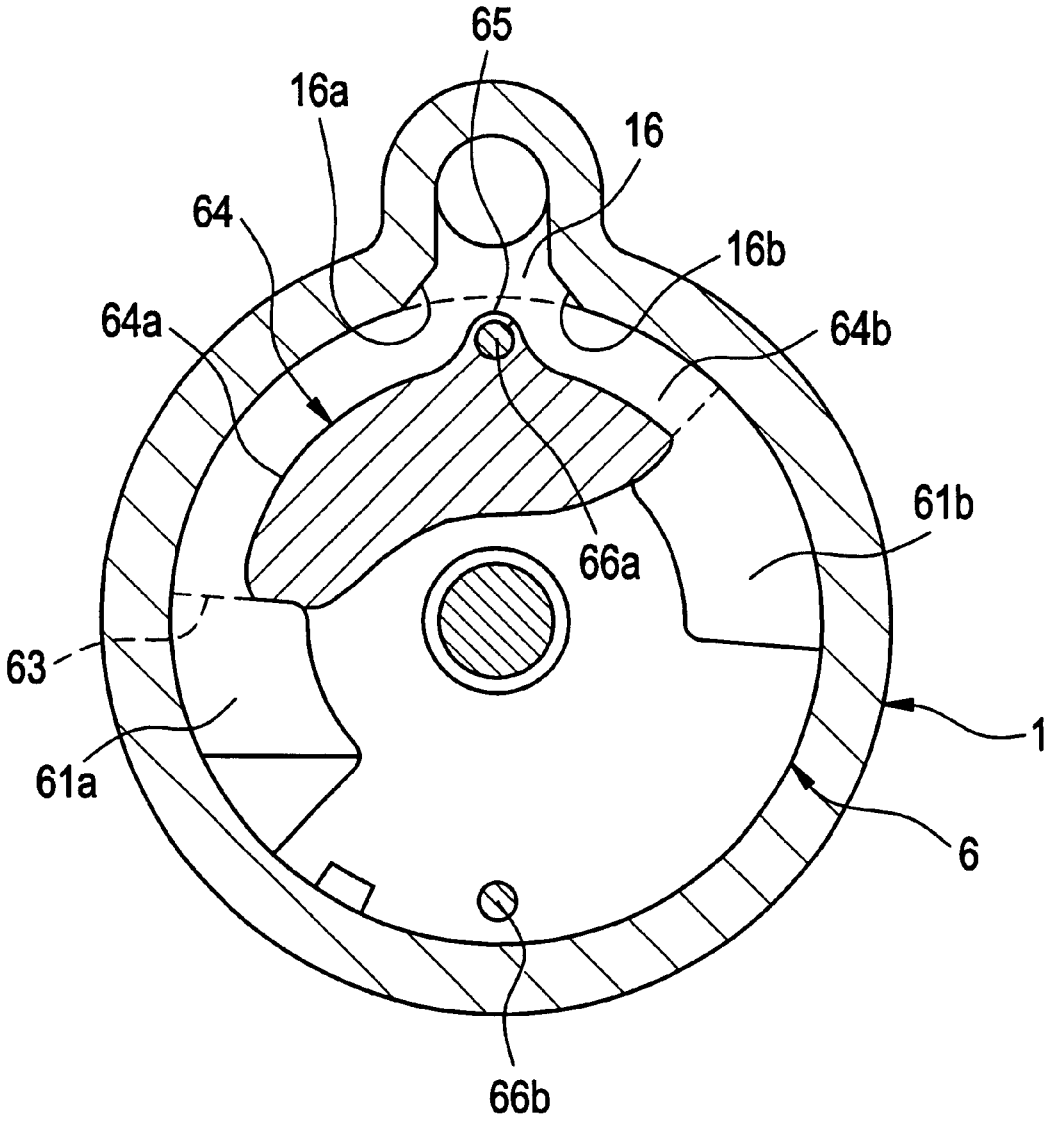
FIG. 7 is a cross sectional view of the first wall member, including a pump housing, of the first embodiment.

As shown in FIGS. 4–7, a connecting portion 16, which connects the inlet 11 (shown in FIG. 2) with an intake passage 64, is provided on an inner surface of the hollow space 12. The intake passage 64 comprises a groove 64*c* formed on an outer surface of the first wall member 6. The groove 64*c* is provided with U-shape cross section, and is formed so that a partition wall portion 63 is defined at a portion between the intake passage 64 and an interface between the first wall member 6 and the cam ring 4. Thus, the inner surface of the hollow space 12, the groove 64*c* and the partition wall portion 63 cooperatively define the intake passage 64. The intake passage 64 connects the inlet 11 with the intake ports 61*a*, 61*b* through the connecting portion 16. As shown in FIG. 7, a distributing wall portion 65, which divides the intake passage 64 into a primary intake passage 64*a* and a secondary intake passage 64*b*, is formed on an inner surface of the intake passage 64. The distributing wall portion 65 is located at which the connecting portion 16 and the intake passage 64 meet together. Both sides of the connecting portion 16 are provided with tapered surfaces 16*a*, 16*b*. Thereby, the fluid directed from the inlet 11 smoothly flows to the intake ports 61*a*, 61*b* through the primary and the secondary intake passages 64*a*, 64*b*, respectively, with the fluid being divided by the distributing wall portion 65.

An operational relationship of these components will be described, assuming that the rotor 5 rotates, according to the FIG. 7, in a clockwise direction. With respect to a location of the inlet 11, the primary intake passage 64*a* is located, on the basis of a rotating direction of the rotor 5, at a retarded position, and the secondary intake passage 64*b* is located at an advanced position. That is, the fluid in the primary intake passage 64*a* flows in a direction opposite to the rotating direction, thereby resisting a rotation of the rotor 5, while the fluid in the secondary intake passage 64*b* flows in the same direction that the rotor 5 rotates. A length of the primary intake passage 64*a* is longer than a length of the secondary intake passage 64*b*. According to the first embodiment of the present invention, the intake passage 64 is formed by a mold that comprises plural components in a circumferential radial direction of the first wall member 6.

Returning to FIG. 2, the first wall member 6, the cam ring 4 and the second wall member 3 are received in the hollow space 12, being positioned with each other by a location of the distributing wall portion 65 and a pair of positioning pins 66*a*, 66*b*. The positioning pin 66*a* is provided at which the distributing wall portion 65 is formed, and the positioning pin 66*b* is symmetrically provided with respect to the radial direction of the first wall member 6. The positioning pins 66*a*, 66*b* penetrate a part of the first wall member 6, the cam ring 4 and a part of the second wall member 3, in those axial directions. An annular groove 17 is formed on the inner surface of the hollow space 12. A stopper-ring member 67 formed into C-shape, having a solid portion 67*a* and an open portion 67*b* as illustrated in FIG. 1, is placed in the annular groove 17, thereby preventing the first wall member 6 from falling off the hollow space 12. The positions of the first wall member 6 and the pump housing 1 are determined, with respect to the circumferential direction of the first wall member 6, by a stopper plate member 8. That is, one end of the stopper plate member 8 is fixed to the other side of the first wall member 6, and the other end of the stopper plate member 8 is fixed to a stopper hole 18 formed at an edge of the hollow space 12 by a screw 82, thereby preventing a relative rotation of the first wall member 6 with respect to the pump housing 1. A sealing ring 19, which seals an interface between the inner surface of the hollow space 12 and the outer surface of the first wall member 6, is provided on the inner surface of the hollow space 12. By this arrangement, the first wall member 6 is arranged in the pump housing 1, closing and sealing an opening of the hollow space 12. A pressure chamber 12*a*, to which the pressurized fluid is directed from the outlet ports 62*a*, 62*b*, is defined at a bottom of the hollow space 12 by the second wall member 3 and the inner surface of the hollow space 12. The other side of the second wall member 3 faces the pressure chamber 12*a*. Thus, the second wall member 3 is urged toward the cam ring 4 by virtue of the pressurized fluid in the pressure chamber 12*a* when the vane pump is running. A pressure-spring 2 is provided in the pressure chamber 12*a* and is arranged so as to urge the second wall member 3 toward the cam ring 4. Therefore, the second wall member 3 is urged toward the cam ring 4 even when the vane pump is out of operation. A sealing ring 31 is provided on an outer surface of the second wall member 3 to seal a first sliding surface formed between the outer surface of the second wall member 3 and the inner surface of the hollow space 12. Also, there is provided another sealing ring 21, which is arranged so as to seal a second sliding surface formed between an outer surface of the pressure-spring 2 and an inner surface of the second wall member 3, in the hollow space 12.

As detailed above, the intake passage 64 that connects the inlet 11 with the intake ports 61*a*, 61*b* comprises the groove 64*c* that is provided with U-shape cross section, and is formed on the outer surface of the first wall member 6 so that the partition wall portion 63 is provided at a portion between the groove and the interface between the first wall member 6 and the cam ring 4. Thereby, the intake passage 64 can be formed within a range of a diameter of the first wall member 6 and an outer diameter of the cam ring 4, overlapping with the outer diameter of the cam ring 4. Therefore, the intake passage 64 that has a large cross sectional area can be provided enough, avoiding upsizing of the vane pump and a decrease of the induction efficiency. Since the intake passage 64 is provided with the U-shaped groove 64*c* in its cross section, a smooth surface can be provided on an inner surface of the intake passage 64, thereby obtaining an effective fluid property.

The second wall member 3 is urged toward the cam ring 4 in the rotation axis by virtue of the pressurized oil when the vane pump is running, thereby improving a characteristic of a hermetic sealing. Thus, an efficiency of pumping can be improved. In addition, since the second wall member 3 is arranged between the bottom surface of the hollow space 12 and the cam ring 4, the pressure chamber 12*a* is defined by the second wall member 3 without requiring another member to provide the pressure chamber 12*a*. Thereby, a component count can be reduced. Furthermore, since the distributing wall portion 65 and the taper surfaces 16*a*, 16*b* are provided on the intake passage 64 and the connecting portion 16, respectively, the fluid directed from the inlet 11 divides into the primary intake passage 64*a* and the secondary intake passage 64*b* with a smooth flow, and thus, a cavitation caused by a steep change of a flow direction can be avoided.

As mentioned previously, the rotor 5 rotates, according to FIG. 7, in the clockwise direction. The fluid led into the primary intake passage 64*a* flows in a counterclockwise direction, while the fluid led into the secondary intake passage 64*b* flows in the clockwise direction. By reasons of this, a difference of a fluid flow velocity between the primary intake passage 64*a* and the secondary intake passage 64*b* is generated. Thereby, an oil pressure in the secondary intake passage 64*b* becomes lower than an oil pressure in the primary intake passage 64*a*. This would cause cavitation and a decrease of the induction efficiency. However, since the length of the secondary intake passage 64*b* is shorter than the length of the primary intake passage 64*a*, cavitation can be inhibited, thereby enhancing the induction efficiency.

The first wall member 6 may be formed by casting. In this case, since the intake passage 64 comprises the groove, a mold that is divided into plural components in the circumferential direction of the first wall member 6 can be utilized to form the intake passage 64. Thereby, the intake passage 64 is provided without using any cores, and thus, a man-hour can be reduced. Furthermore, since the inner surface of the intake passage 64 is provided without using the core, a smooth surface can be provided, as compared to the inner surface of the intake passage 64 formed utilizing the core that is formed by sand. Thereby, an induction resistance can be decreased. Moreover, according to the first embodiment of the present invention, since there is no need to use the sand-made core to form the intake passage 64, a die-cast process that utilizes a high-pressure can be applied.

Before the first wall member 6, the cam ring 4 and the second wall member 3 are mounted in the hollow space 12, those are previously positioned together in the circumferential direction of the first side wall member 6 by the positioning pins 66*a*, 66*b*. Then, the first wall member 6 is fixed to the pump housing 1 by the stopper plate member 8. That is, the first wall member 6, the cam ring 4, the second wall member 3 and the pump housing 1 are put together with those being positioned in the circumferential direction of the first wall member 6, thereby simplifying an assembly process of the vane pump. Consequently, an assembly efficiency can be improved. Furthermore, since the positioning pin 66*a* is provided at which the distributing wall portion 65 is formed, and since the positioning pin 66*b* is symmetrically provided at a portion opposite to the distributing wall portion 65 with respect to the radial direction of the first wall member, the positioning pins 66*a*, 66*b* position the first wall member 6, the cam ring 4 and the second wall member 3 at an outer periphery of the respective members. Thereby, a positioning force by the positioning pins 66*a*, 66*b* against a rotation torque can be secured.

Next, a vane pump according to the second embodiment of the present invention will be described referring to the drawings. Parts of this embodiment that corresponds to parts of the first embodiment are given the same or similar reference characters, and only differences from the first embodiment will be described. FIGS. 8–12 show the second embodiment of the present invention. According to the second embodiment of the present invention, a lid member 9 formed into annular shape and a stopper mechanism instead of the stopper plate member 8 are provided at the one side of the pump housing 1. The pressure-spring 2 comprises a coil spring, and the stopper mechanism comprises a stopper groove 69 and a pin 20. The stopper groove 69 is formed on the outer surface of the first wall member 6. A male screw is formed on an outer surface of a small diameter portion 68 that is provided at the other side of the first wall member 6. A female screw is formed on an inner surface of the lid member 9. By this manner, the lid member 9 is fixed to the other side of the first wall member 6. An outer surface of the lid member 9 is provided with a tapered surface 91 so that a diameter of the lid member decreases toward the first wall member 6. A part of the inner surface of the hollow space 12 that faces the outer surface of the lid member 9 is provided with a tapered surface 12*b* so that a diameter of the part decreases toward the bottom surface of the hollow space 12.

The one side of the pump housing 1 is sealed by two sealing rings 92, 93. The sealing ring 92 is disposed on the tapered surface 91 and seals an interface between the tapered surfaces 12*b*, 91. The sealing ring 93 is provided at a root portion of the small diameter portion 68 and is arranged so as to seal an interface between the lid member 9 and the first wall member 6. According to the second embodiment of the present invention, since the two searing rings 92, 93 are provided at the tapered surface 91 and the root portion of the small diameter portion 68, respectively, a sealing ring that seals an interface between the inner surface of the hollow space 12 and the outer surface of the first wall member 6 is unnecessary. A projection 94 that restricts a movement of the stopper-ring member 67 in a radial direction of the stopper ring member 67 is provided on the outer surface of the lid member 9. According to the second embodiment of the present invention, the seal ring 31 is arranged at the bottom surface of the hollow space 12. Thereby, the first wall member 6, the cam ring 4 and the second wall member 3 are positioned with each other, before mounting in the hollow space 12, by the positioning pins 66*a*, 66*b* in the circumferential direction of the first wall member 6. Then, those are mounted in the hollow space 12, adapting a position of the stopper groove 69 to the pin 20. The pin 20 positions the stopper groove 69 from the radial direction of the first wall member 6. Thereby, a position of the pump housing 1, the first wall member 6, the cam ring 4 and the second wall member 3 is defined with respect to the circumferential direction of the first wall member 6. Then, the stopper-ring member 67 is placed in the annular groove 17 to prevent the first wall member 6 from falling off the hollow space 12. Finally, the first wall member 6 and the lid member 9 are fixed together. Since the projection 94 is provided on the outer surface of the lid member 9, the movement of the stopper-ring member 67 is restricted in its radial direction, thereby preventing both the stopper-ring member 67 and the first side wall member 6 from falling off the hollow space 12.

Figure 13:
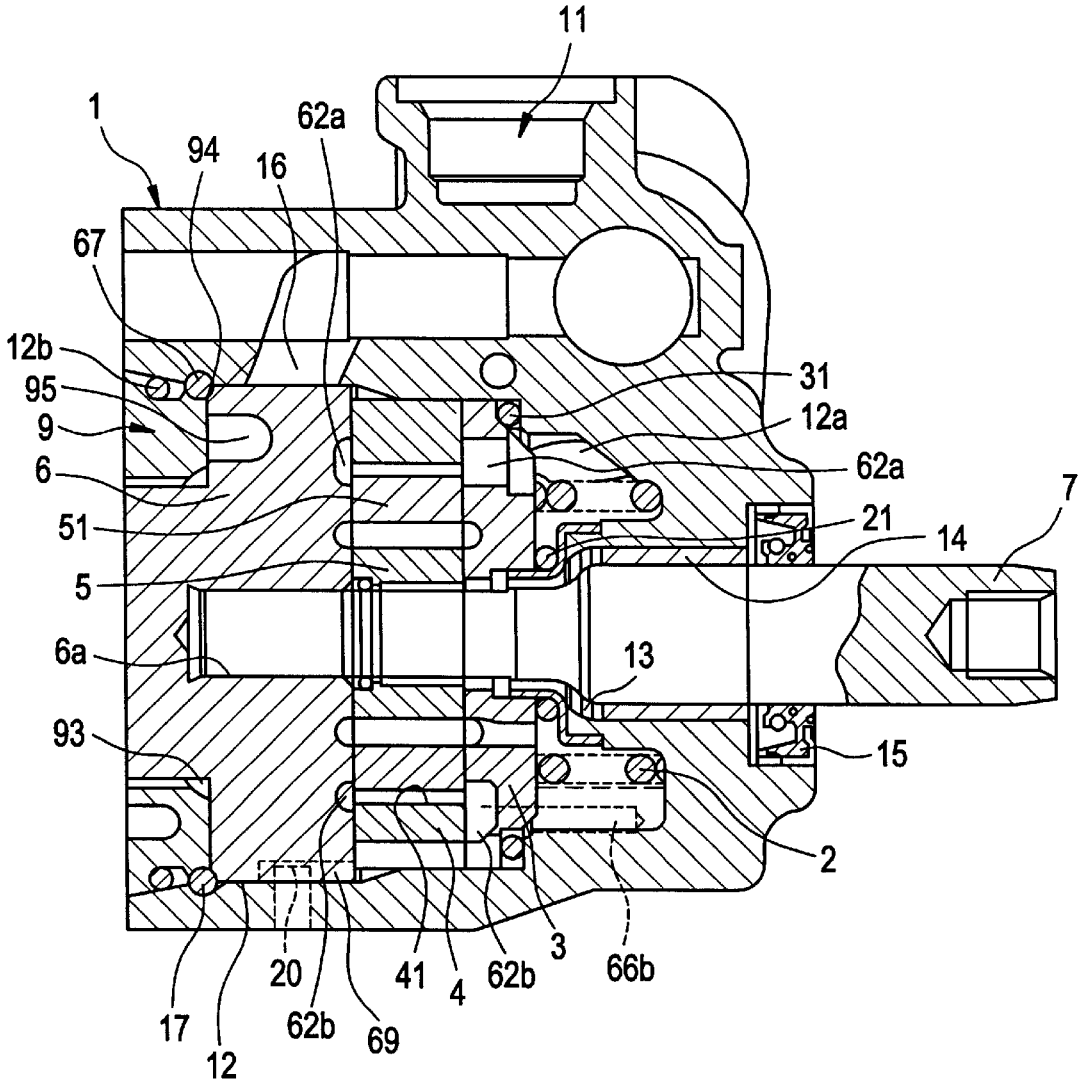
FIG. 13 is a longitudinal sectional view of a vane pump according to a third embodiment of the present invention.
Figure 14:
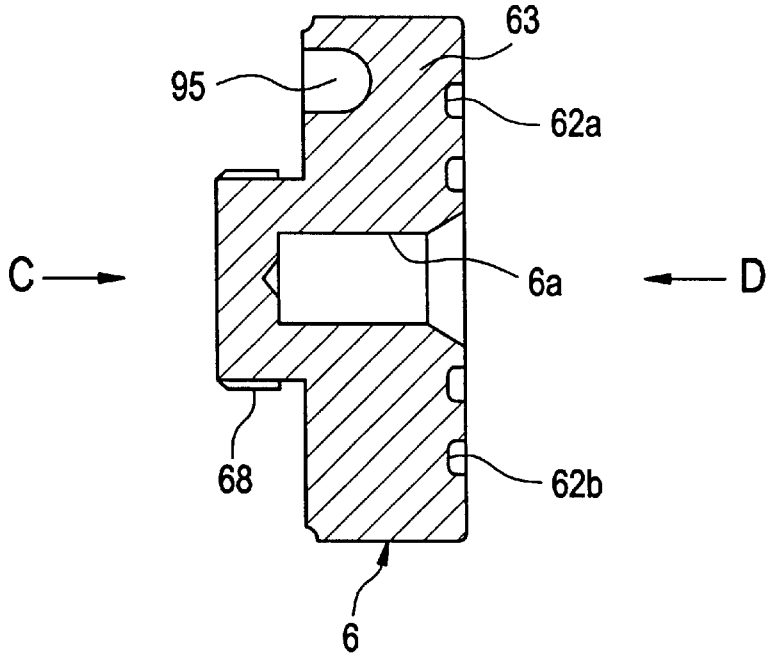
FIG. 14 is a cross sectional view of a first wall member of the third embodiment.
Figure 15:
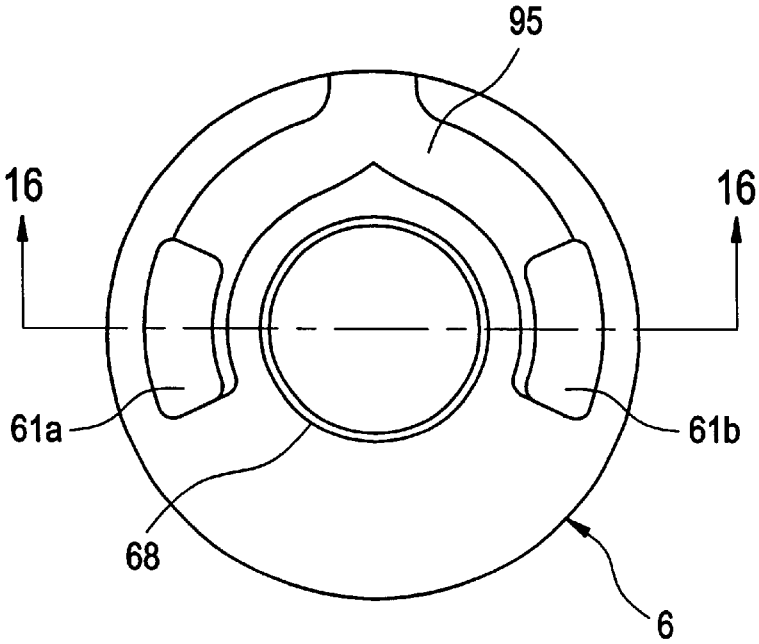
FIG. 15 is a side view taken from arrow C of FIG. 14.
Figure 16:
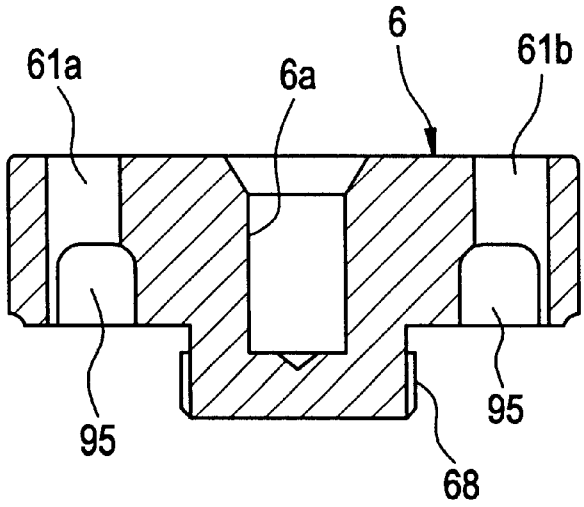
FIG. 16 is a cross sectional view of the first wall member taken on line 16—16 of FIG. 15.
Figure 17:
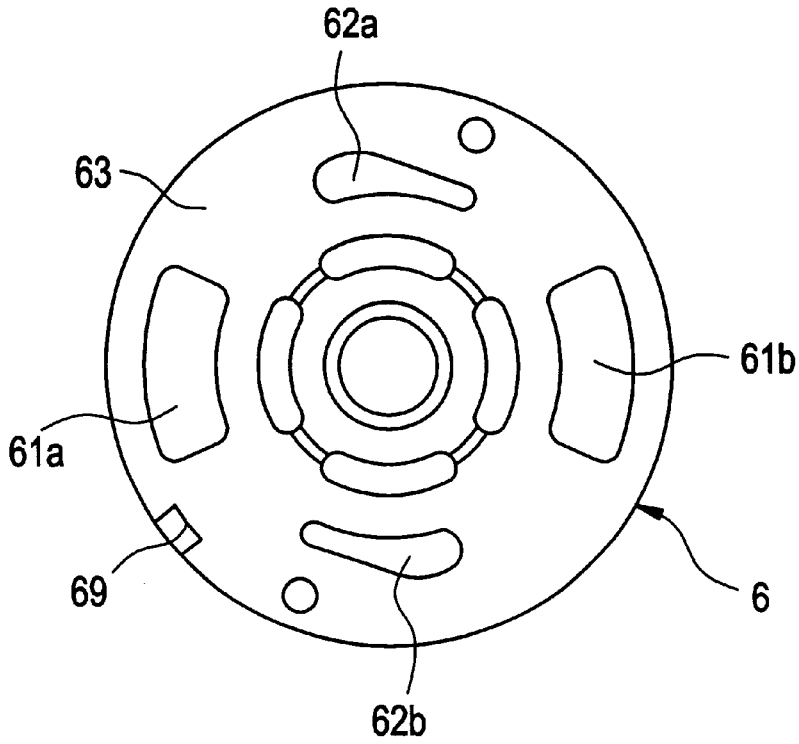
FIG. 17 is a side view taken from arrow D of FIG. 14.
Figure 18:
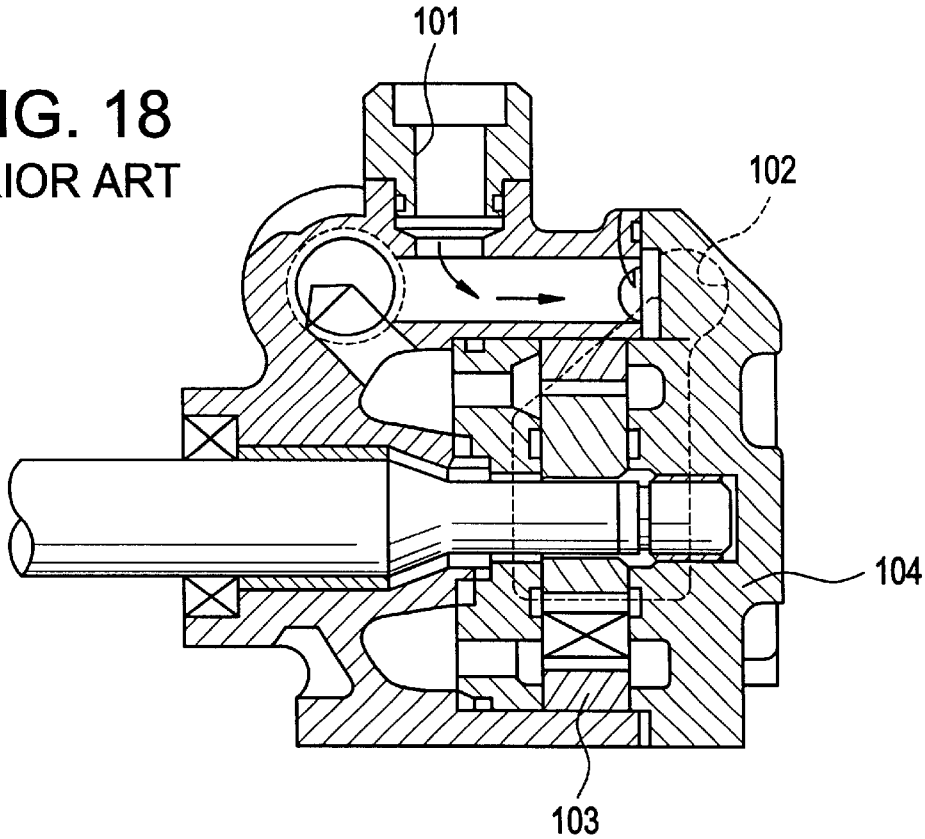
FIG. 18 PRIOR ART
FIG. 18 is a longitudinal sectional view of a first conventional vane pump.
Figure 19:
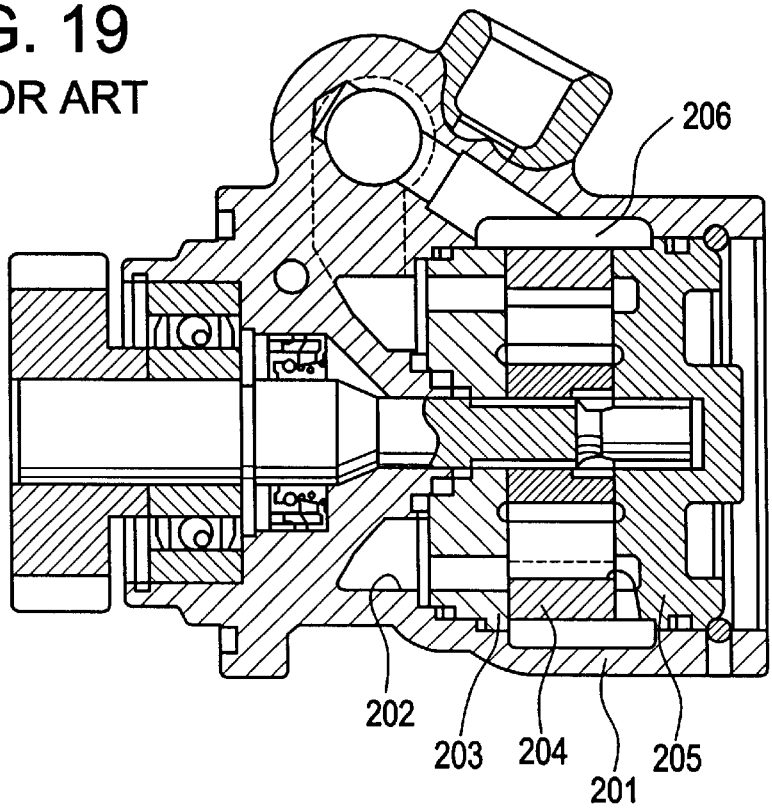
FIG. 19 PRIOR ART
FIG. 19 is a longitudinal sectional view of a second conventional vane pump.

Next, a vane pump according to the third embodiment of the present invention will be described referring to the drawings. Parts of this embodiment are given the same or similar reference characters to corresponding parts of the first embodiment, and only differences from the first embodiment will be described. FIGS. 13–17 show the third embodiment of the present invention. According to the third embodiment, as shown in FIGS. 13, 14 and 16, an intake passage 95 is formed on the other side of the first wall member 6. The intake passage 95 is defined by the first wall member 6 and the lid member 9. Thereby, the intake passage 95 is formed within the diameter of the first wall member 6, and thus, an upsizing of the vane pump in its radial direction can be avoided, as in the first embodiment and the second embodiment of the present invention.

Figure 8:
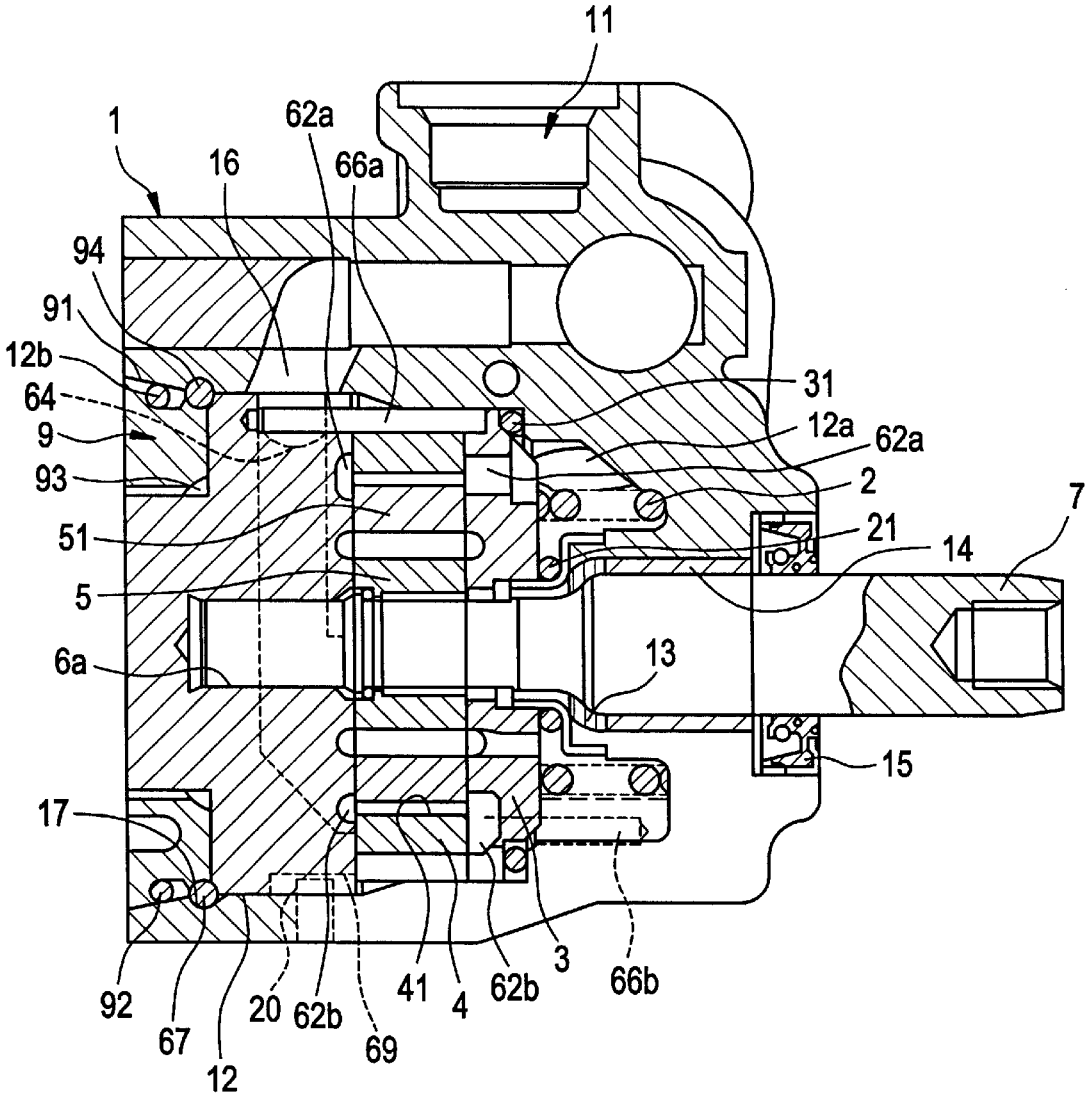
FIG. 8 is a longitudinal sectional view of a vane pump according to a second embodiment of the present invention and FIG. 8A is a partial front view of the second embodiment.
Figure 8A:
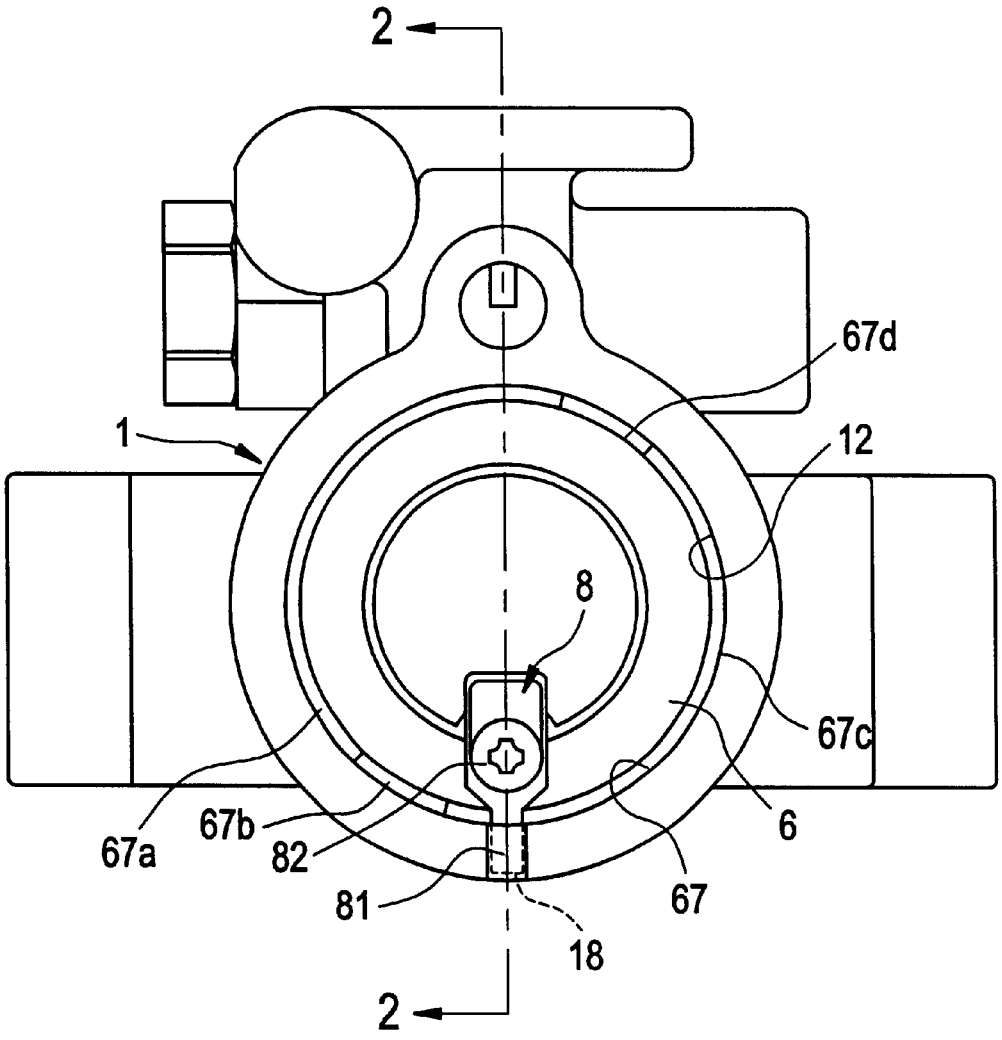
Figure 9:
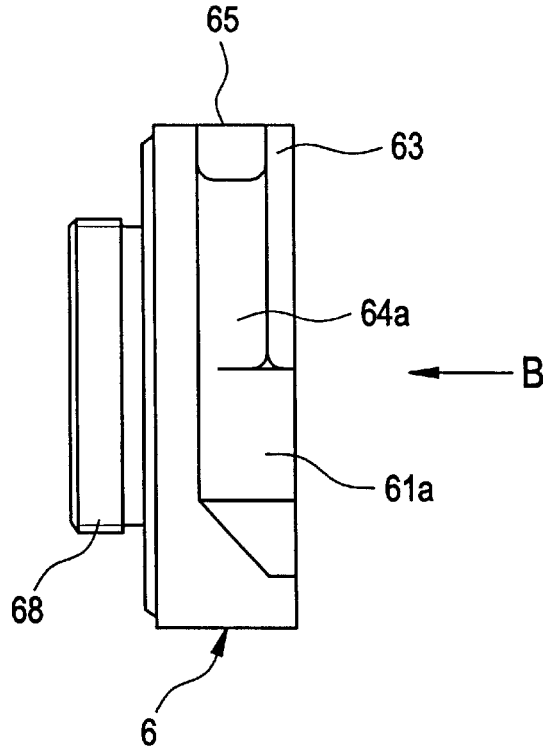
FIG. 9 is a side view of a first wall member of the second embodiment.
Figure 10:
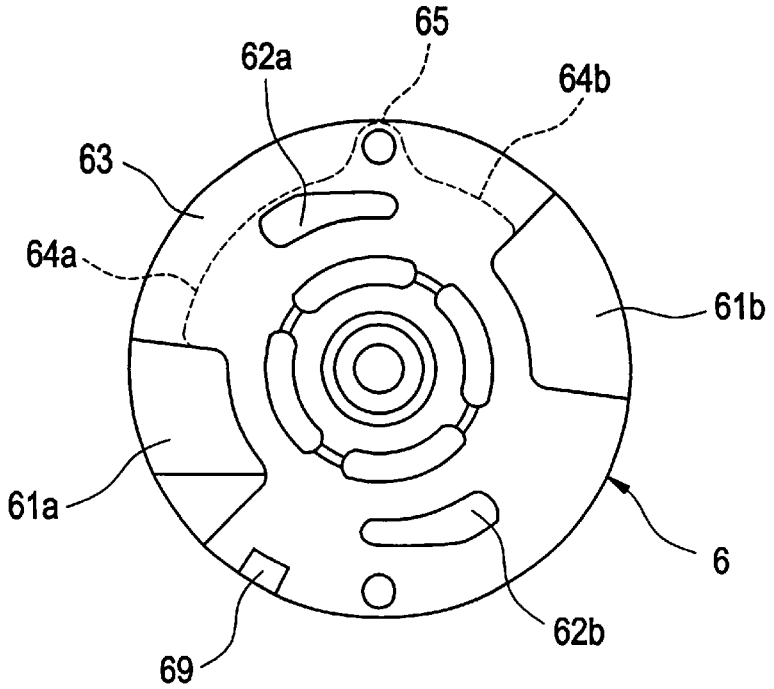
FIG. 10 is a side view taken from arrow B of FIG. 9.
Figure 11:
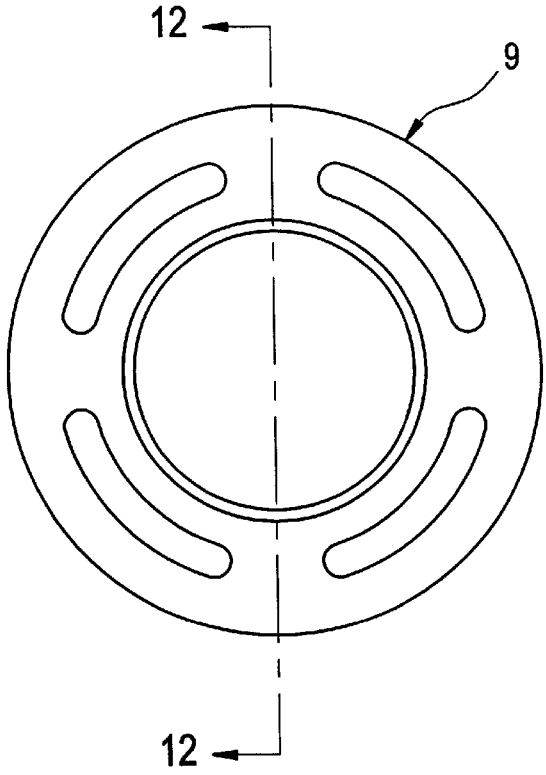
FIG. 11 is a front view of a lid member.
Figure 12:
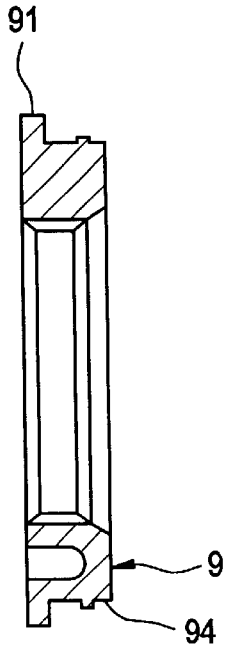
FIG. 12 is a cross sectional view of the lid member taken on line 12—12 of FIG. 11.

The present embodiments are to be considered as illustrative and not restrictive and the invention is not to be limited to the details given herein, but may be modified. For example, although the stopper-ring member 67 is formed into C-shape, it may also comprise several components in a circumferential direction of the stopper-ring 67, for example, solid portion 67*a* in FIG. 1 could be cut into two portions 67*a* and 67*c*, thus forming a second space 67*d*, as illustrated in FIG. 8A, which illustrates a front view of FIG. 8 (without the lid member being shown). In this case, since the stopper-ring member 67 comprises the several components, an attachment and a detachment of the stopper-ring member 67 can be performed easily, as compared to the stopper-ring member comprises one component. Thereby, the number of man-hours that are required to assemble the elements of the vane pump can be reduced. Furthermore, since the stopper-ring member 67 comprises the several components, it may be made of a metal other than a spring-material. Thereby, material costs of the stopper-ring member can be decreased.

While the present invention is described on the basis of certain preferred embodiments, it is not limited thereto, but is defined by the appended claims as interpreted in accordance with applicable law.

This application relates to and incorporates herein by reference Japanese Patent application No. 2000-330896 filed on Oct. 30, 2000, from which priority is claimed.

What is the claimed is:

1. A vane pump, comprising:

a pump housing including an inlet, an outlet, and therein a hollow space;

a cam ring received in the hollow space and defining an inner space, said cam ring having an inner surface and side surfaces;

a rotor placed in the inner space defined by the cam ring and defining a rotation axis, the rotor comprising plural vanes arranged in corresponding slots formed in the rotor, said vanes being adapted to have a slidable contact with the cam ring inner surface and movement in a radial direction of the rotor;

a first wall member received in the hollow space and having side surfaces, one side surface of the first wall member facing one side surface of the cam ring, the first wall member comprising an intake passage provided with a groove that is formed on an outer cylindrical surface of the first wall member so that a partition wall portion is defined between the groove and an interface between a side surface of the first wall member and a side surface of the cam ring;

a pair of intake ports formed on the one side surface of the first wall member, each intake port being connected with the inlet by the intake passage; and a pair of outlet ports formed on the one side surface of the first wall member.

2. The vane pump according to claim 1, further comprising a second wall member having side surfaces and received in the hollow space with a movable contact with respect to the cam ring in the direction of the rotation axis, one side surface of the second wall member facing the other side surface of the cam ring; and wherein the first wall member, the cam ring and the second wall ember are arranged so that the cam ring is placed between the first wall member and the second wall member.

3. The vane pump according to claim 2, wherein the hollow space has an opening that opens at one side of the pump housing, and the opening is closed by the first wall member.

4. The vane pump according to claim 3, wherein the second wall member and the hollow space cooperatively define a pressure chamber at a bottom of the hollow space.

5. The vane pump according to claim 4, wherein the other side of the second wall member receives a pressurized fluid directed from the outlet ports.

6. The vane pump according to claim 5, further comprising a spring provided in the hollow space for urging the second wall member toward the cam ring.

7. The vane pump according to claim 6, wherein the spring comprises a plate spring.

8. The vane pump according to claim 6, wherein the inlet and the intake passage are connected together by a connecting portion provided between the inlet and the intake passage, and a width of the connecting portion increases toward the intake passage; and wherein a distributing wall portion is formed on an inner surface of the intake passage, the distributing wall portion is located at a portion that faces the connecting portion, the distributing wall portion divides the intake passage into a primary intake passage and a secondary intake passage.

9. The vane pump according to claim 8, wherein the primary intake passage is located at a portion that a fluid directed from the inlet flows to one of the intake port in an opposite direction of a rotating direction of the rotor, and the secondary intake passage is located at a portion that the fluid flows to the other intake port in the same direction as the rotating direction of the rotor; and wherein a length of the primary intake passage is longer than a length of the secondary intake passage.

10. The vane pump according to claim 9, wherein the intake passage is formed with U-shape cross section.

11. The vane pump according to claim 1, wherein the intake passage is formed on an outer surface of the first wall member and is defined by an inner surface of the hollow space, the groove and the partition wall portion.

12. The vane pump according to claim 11, wherein the intake passage is formed by a mold that comprises plural components in a circumferential direction thereof.

13. The vane pump according to claim 10, wherein the intake passage is formed on an outer surface of the first wall member and is defined by an inner surface of the hollow space, the groove and the partition wall portion.

14. The vane pump according to claim 13, wherein the intake passage is formed by a mold that comprises plural components in a circumferential direction thereof.

15. The vane pump according to claim 13, further comprising:

a stopper ring member placed on an annular groove formed on the inner surface of the hollow space, the stopper ring member preventing a movement of the first wall member in an axial direction of the first wall member; and a lid member fixed to the other side of the first wall member.

16. The vane pump according to claim 13, further comprising:

a pair of positioning pins for positioning the first wall member, the cam ring and the second wall member each other in those circumferential directions, the positioning pins positioning the first wall member, the cam ring and the second wall member from those axial directions.

17. The vane pump according to claim 16, wherein one of the positioning pins is arranged at which the distributing wall portion is provided, and the other positioning pin is arranged at a portion that is symmetrical with respect to a radial direction of the first wall member.

18. The vane pump according to claim 17, further comprising a stopper member provided at the one side of the pump housing for preventing a relative rotation of the first wall member with respect to the pump housing.

19. The vane pump according to claim 4, further comprising:

a stopper ring member placed on an annular groove formed on an inner surface of the pump housing, the stopper ring member preventing a movement of the first wall member in an axial direction of the first wall member; and a lid member fixed to the other side of the first wall member; and wherein the intake passage is formed on the other side of the first wall member, the intake passage is defined by the lid member, the groove and the partition wall portion.

20. The vane pump according to claim 19, wherein the intake passage is formed with U-shape cross section.

21. The vane pump according to claim 20, wherein a projection is formed on the outer surface of the lid member, the projection precludes a movement of the stopper ring member in a radial direction of the stopper ring member.

22. The vane pump according to claim 21, wherein the stopper ring member comprises plural components in a circumferential direction thereof.

23. The vane pump according to claim 19, wherein the other side of the second wall member receives a pressurized fluid directed from the outlet ports.

24. The vane pump according to claim 23, further comprising a spring provided in the pressure chamber for urging the second wall member toward the cam ring.

25. The vane pump according to claim 24, wherein the spring comprises a coil spring.

26. A vane pump, comprising:

a pump housing including an inlet, an outlet, and therein a hollow space that has an opening at an end face of the pump housing;

a cam ring received in the hollow space and defining an inner space, said cam ring having an inner surface and side surfaces;

a rotor placed in the inner space defined by the cam ring and defining a rotation axis, the rotor comprising plural vanes that are arranged in corresponding slots formed in the rotor, said vanes being adapted to have a slidable contact with the cam ring inner surface and movement in a radial direction of the rotor;

a first wall member received in the hollow space, the first wall member having side surfaces and closing the opening, one side surface of the first wall member facing one side surface of the cam ring;

a second wall member having side surfaces and received in the hollow space with a movable contact with respect to the cam ring in the direction of the rotation axis, one side surface of the second wall member facing the other side surface of the cam ring, the second wall member being arranged to form a pressure chamber at a bottom of the hollow space, the other side surface of the second wall member facing the pressure chamber;

a pair of intake ports formed on the one side surface of the first wall member;

a pair of outlet ports formed on the one side surface of the first wall member;

an intake passage provided on an outer surface of the first wall member, the intake passage comprising a groove that is formed so that a partition wall portion is defined at a portion between the intake passage and an interface between the first wall member and a side surface of the cam ring, the intake passage connecting each intake port with the inlet;

a spring provided in the pressure chamber for urging the second wall member toward the cam ring; and a pair of positioning pins positioning the first wall member, the cam ring and the second wall member together in those circumferential directions, the positioning pins positioning the first wall member, the cam ring and the second wall member from those axial directions.

27. A vane pump, comprising:

a pump housing including an inlet, an outlet, and therein a hollow space that has an opening at an end face of the pump housing;

a cam ring received in the hollow space and defining an inner space, said cam ring having an inner surface and side surfaces;

a rotor placed in the inner space defined by the cam ring and defining a rotation axis, the rotor comprising plural vanes that are arranged in corresponding slots formed in the rotor, said vanes being adapted to have a slidable contact with the cam ring inner surface and movement in a radial direction of the rotor;

a first wall member received in the hollow space, the first wall member closing the opening, one side surface of the first wall member facing one side surface of the cam ring;

a second wall member received in the hollow space with a movable contact with respect to the cam ring in the direction of the rotation axis, one side surface of the second wall member facing the other side surface of the cam ring, the second wall member being arranged to form a pressure chamber at a bottom of the hollow space, the other side surface of the second wall member facing the pressure chamber;

a lid member fixed to the other side surface of the first wall member;

a pair of intake ports formed on the one side surface of the first wall member;

a pair of outlet ports formed on the one side surface of the first wall member;

an intake passage provided on the other side surface of the first wall member, the intake passage comprising a groove that is formed so that a partition wall portion is defined at a portion between the intake passage and an interface between a side surface of the first wall member and a side surface of the cam ring, the intake passage connecting each intake port with the inlet;

a spring provided in the pressure chamber urging the second wall member toward the cam ring;

a stopper ring member placed on an annular groove formed on an inner surface of the pump housing, the stopper ring member preventing a movement of the first wall member in the rotation axis; and a projection formed on the outer surface of the lid member, the projection precluding a movement of the stopper ring member in a radial direction of the stopper ring member.

* * * * *